US007742710B2

(12) United States Patent
Miura et al.

(10) Patent No.: US 7,742,710 B2
(45) Date of Patent: Jun. 22, 2010

(54) IMAGE FORMING APPARATUS INCLUDING TWO TONER ACCOMODATION PORTIONS

(75) Inventors: Yukihiro Miura, Toride (JP); Takayuki Suzuki, Kashiwa (JP); Takashi Yahagi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 60 days.

(21) Appl. No.: 12/019,268

(22) Filed: Jan. 24, 2008

(65) Prior Publication Data

US 2008/0187357 A1 Aug. 7, 2008

(30) Foreign Application Priority Data

Feb. 1, 2007 (JP) ..... 2007-023042

(51) Int. Cl.
*G03G 15/08* (2006.01)

(52) U.S. Cl. ..... 399/27

(58) Field of Classification Search ..... 399/27
See application file for complete search history.

(56) References Cited

U.S. PATENT DOCUMENTS

| | | | | |
|---|---|---|---|---|
| 4,937,624 | A | 6/1990 | Kohtani et al. | |
| 4,937,626 | A | 6/1990 | Kohtani et al. | |
| 6,118,951 | A | 9/2000 | Kato et al. | |
| 7,206,528 | B2 * | 4/2007 | Matsunai | 399/43 |
| 7,242,878 | B2 | 7/2007 | Kojima et al. | |
| 7,254,348 | B2 * | 8/2007 | Yahagi | 399/27 |
| 7,349,639 | B2 | 3/2008 | Kojima et al. | |
| 2003/0152394 | A1 * | 8/2003 | Nakase et al. | 399/27 |
| 2006/0029404 | A1 * | 2/2006 | Hirota et al. | 399/27 |
| 2008/0187357 | A1 * | 8/2008 | Miura et al. | 399/120 |

FOREIGN PATENT DOCUMENTS

| | | | |
|---|---|---|---|
| JP | 4-336567 | A | 11/1992 |
| JP | 8-137227 | A | 5/1996 |
| JP | 10-221939 | A | 8/1998 |
| JP | 2002014533 | A * | 1/2002 |
| JP | 2002-357945 | A | 12/2002 |
| JP | 2005-54072 | A | 3/2005 |
| JP | 2005-84072 | A | 3/2005 |
| JP | 2005-241865 | A | 9/2005 |
| JP | 2006091589 | A * | 4/2006 |

OTHER PUBLICATIONS

Korean Notice Requesting Submission of Opinion dated Aug. 4, 2009, in counterpart Korean Application No. 10-2008-0010721, and an English-language translation thereof.

* cited by examiner

*Primary Examiner*—Quana M Grainger
(74) *Attorney, Agent, or Firm*—Fitzpatrick, Cella, Harper & Scinto

(57) ABSTRACT

An image forming apparatus includes a controller for controlling, when a developer is accommodated in a developing container, a discharging device such that an amount of developer in a first accommodating portion is not less than a first amount, in accordance with a detection result of a first detecting device and such that an amount of developer in a second accommodating portion is not less than a second amount, in accordance with a detection result of a second detecting device, and for permitting, when the developing container is substantially empty, and the amount in the first accommodating portion is less than the first amount, an image forming operation to continue until the amount in the second developer portion becomes less than the second amount.

5 Claims, 13 Drawing Sheets

IMAGE FORMING APPARATUS INCLUDING TWO TONER ACCOMODATION PORTIONS

FIELD OF THE INVENTION AND RELATED ART

The present invention relates to an image forming apparatus such as an electrophotographic copying machine, printer, etc.

In the field of an image forming apparatus, such as an electrophotographic copying machine, printer, etc., a replaceable developer cartridge is employed to make it easier for a user to replenish a developing apparatus with developer (toner) without contaminating a user's hand with developer (toner).

Generally, in the case of an image forming apparatus which is excellent in operability, its developer cartridge slots are located on top, or in a top portion, of a main assembly of the image forming apparatus. A developer cartridge is to be set in the developer cartridge slot by a user. As a developer cartridge is mounted in the developer cartridge slot, the developer in the developer cartridge is delivered, as necessary, from the developer cartridge to the developing apparatus of the image forming apparatus, by a developer conveyance mechanism of the main assembly.

A conventional developer dispensing apparatus is provided with a developer storage, in which the developer from a developer cartridge is temporality stored. It is also provided with a sensor for detecting the amount of the developer in the developer storage. As it is detected that the amount of the developer in the developer storage has remained the same, even though the operation for delivering developer from the developer cartridge to the developer storage has been carried out for a preset length of time, it is determined that the developer cartridge is empty. Then, a message which prompts a user to replace the developer cartridge in the apparatus main assembly is displayed on a monitor of a control panel of the main assembly.

However, the image forming operation does not need to be stopped as soon the above-mentioned message is displayed. That is, the image forming operation can be continued until the amount of the developer in the developer storage falls below a preset value. In other words, if the empty developer cartridge in the main assembly of the image forming apparatus can be replaced, without interrupting the image forming operation, before the amount of the developer in the developer storage falls below the preset value, the image forming operation can be continued with no "downtime" (for example, Japanese Laid-open Patent Applications 2005-84072 and 2005-241865).

In the case of an electrophotographic copying machine, which forms an image by adhering developer to an electrostatic latent image on an image bearing member, such as a photosensitive drum, keeping the toner density of the developer in the developing apparatus at a proper level is important for the purpose of ensuring that the coping machine continuously outputs images of high quality. Therefore, the operation for replenishing the developing apparatus with developer has to be carried out at a high level of accuracy.

Therefore, in the case of the conventional developer dispensing apparatus (disclosed in Japanese Laid-open Patent Application 2005-54072), the developer from the developer cartridge is temporarily stored in the developer storage of the developer dispensing apparatus, since the amount by which developer is delivered from the developer cartridge is affected by the amount of the developer remaining in the developer cartridge, being therefore unlikely to remain stable. Then, the driving of the developer storage is controlled based on the toner density in the developing apparatus; the amount by which developer is delivered to the developing apparatus is very precisely controlled.

There has been proposed another method for stabilizing the amount by which developer is delivered to the developing apparatus (Japanese Laid-open Patent Application 2002-357945). According to this method, in order to stabilize the amount by which developer is delivered to the developing apparatus, the developer dispensing apparatus is driven for a preset length of time to fill up the developer delivery passage with developer, during the initialization of an image forming apparatus, to ensure that the amount by which developer is delivered thereafter to the developing apparatus remains stable.

However, with the recent increase in the operational speed of an image forming apparatus, and/or the usage of an image forming apparatus in the field of the POD (print-on-demand) business (which puts image forming apparatuses to substantially heavier usage than an ordinary user), the conventional developing delivering apparatuses described above have become unsatisfactory.

Thus, demand has been increasing for means for reducing the frequency with which a developer cartridge has to be replaced, because the reduction in the developer cartridge replacement frequency can increase the length of time an image forming apparatus can be continuously operated without an interruption (downtime), and without requiring a user (operator) to remain in the vicinity of the apparatus, and therefore, it reduces the amount of time and labor required of the user.

However, simply increasing a developer cartridge in size (capacity) reduces the efficiency with which a user can replace a developer cartridge. Further, if a developer cartridge packed with a large amount of developer is left in storage for a substantial length of time, the developer in the cartridge is likely to solidify. The solidified developer is likely to add to the above-mentioned problem. In other words, simply increasing a developer cartridge in size is likely to add to the above-mentioned problems when the cartridge is put to actual use.

Thus, there have been made the following proposals, which make it possible for a developer dispensing apparatus to accommodate two or more developer cartridges full of developer (toner) to make it easier for a user to operate an image forming apparatus (for example, Japanese Laid-open Patent Applications H08-137227 and H10-221939).

However, structuring a developer dispensing apparatus, as described in the above-mentioned proposals, so that multiple developer cartridges can be mounted in the developer dispensing apparatus requires multiple developer cartridge slots (inclusive of means for detecting developer cartridge, a mechanism for driving developer cartridge, and a mechanism for opening or closing developer cartridge lid, etc.). It also requires means for determining, and showing, which developer cartridge is empty, being therefore ready to be replaced. Further, it contributes very little to solving of the problem that the amount by which developer can be discharged from a developer cartridge is affected by the changes in the amount of the developer remaining in the developer cartridge.

Another means for extending the length of time an image forming apparatus can continuously operate without an interruption (downtime) is to increase a developer cartridge in capacity (size). However, increasing a developer cartridge in capacity (size) makes it necessary to increase a developer dispensing apparatus in size, making it difficult to place a developer dispensing apparatus (which is large in capacity) in the vicinity of a developing apparatus. Moreover, in the case of an image forming apparatus employing a developer cartridge of a large capacity, its developer dispensing apparatus is desired to be placed in the top portion of the main assembly of the image forming apparatus, for operability. With the developer dispensing apparatus placed in the top portion of the image forming apparatus, the distance from the developer storage to the developing apparatus is greater than that in a conventional image forming apparatus; developer has to be conveyed a relatively longer distance than in the conventional image forming apparatus. Thus, a developer dispensing apparatus capable of accommodating a developer cartridge of a large capacity is lower in the accuracy with which it delivers developer to the developing apparatus, being therefore likely to make the toner density of the developer in the developing apparatus fluctuate.

SUMMARY OF THE INVENTION

Thus, the primary object of the present invention which was made in consideration of the problems described above is to provide an image forming apparatus which is substantially lower in the frequency with which a user has to replace a developer cartridge, being therefore smaller in the amount of work which a user has to do to replace a developer cartridge, than a conventional image forming apparatus, and yet, is stable in the amount by which developer is delivered to its developing apparatus.

According to an aspect of the present invention, there is provided an image forming apparatus comprising an image bearing member on which an electrostatic image is to be formed; a developing device for developing the electrostatic image with a developer; a developer container detachably mountable to a mounting portion provided in a main assembly of the apparatus, for accommodating a supply of developer; a discharging device for discharging the supply of developer from said developer container mounted to said mounting portion to an outside of said developer container; a first developer accommodating portion for receiving the developer from said discharging device and for accommodating an amount of the developer which exceeds a first predetermined amount, wherein the first predetermined amount is larger than a capacity of said developer container; a first detecting device for detecting an amount of the developer in said first developer accommodating portion; a first supplying device for supplying the developer in said first developer accommodating portion to an outside of said first developer accommodating portion; a second developer accommodating portion for receiving the developer from said first supplying device and for accommodating an amount of the developer which exceeds a second predetermined amount; a second detecting device for detecting the amount of the developer in said second developer accommodating portion; a second supplying device for supplying the developer from said second developer accommodating portion toward said developing device; a controller for controlling, when the developer is accommodated in said developing container, said discharging device such that amount of the developer in said first developer accommodating portion is not less than the first predetermined amount, in accordance with a detection result of said first detecting device and such that such that amount of the developer in said second developer accommodating portion is not less than the second predetermined amount, in accordance with a detection result of said second detecting device, and for permitting, when said developing container is substantially empty, and the amount of the developer in said first developer accommodating portion is less than the first predetermined value, an image forming operation to continue until the amount of the developer in said second developer accommodating portion becomes less than the second predetermined amount.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the image forming apparatuses in the preferred embodiments of the present invention will be described in more detail with reference to the appended drawings.

Embodiment 1

(1) Example of Image Forming Apparatus

Figure 3:
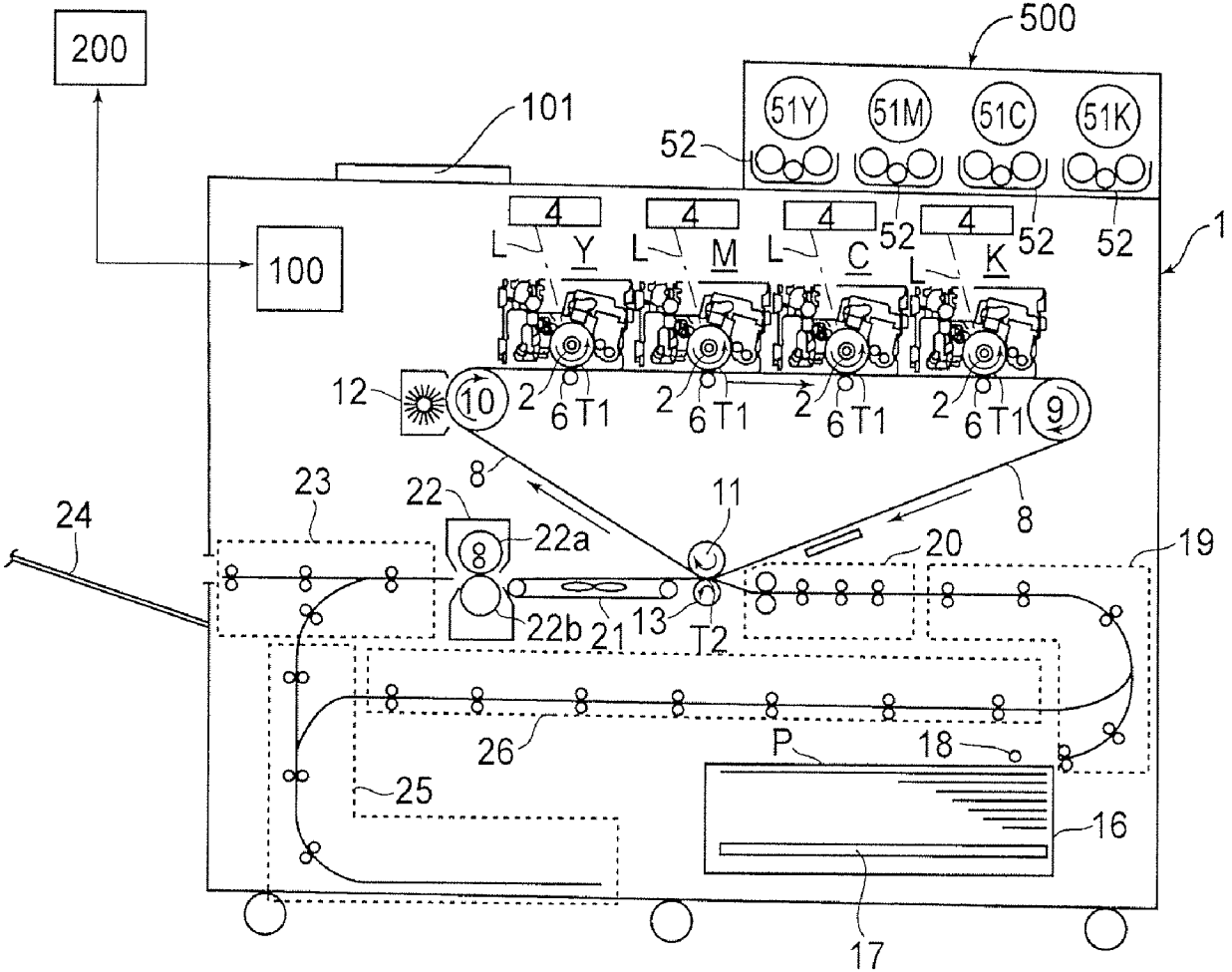
FIG. 3 is a schematic sectional view of the image forming apparatus according to the first embodiment of the present invention, showing the general structure of the apparatus.

FIG. 3 is a schematic sectional view of the image forming apparatus according to an embodiment of the present invention, and shows the general structure of the apparatus. This image forming apparatus is an electrophotographic full-color laser printer which employs an intermediary transfer belt and four photosensitive members. The four photosensitive drums are juxtaposed in parallel (arranged in tandem). The image forming apparatus outputs on a sheet of recording medium P, an image which reflects electrical pictorial signals inputted from an external host apparatus 200 connected to the control circuit 100 (CPU). The external host apparatus 200 is a computer, an image reader, or the like.

Figure 2:
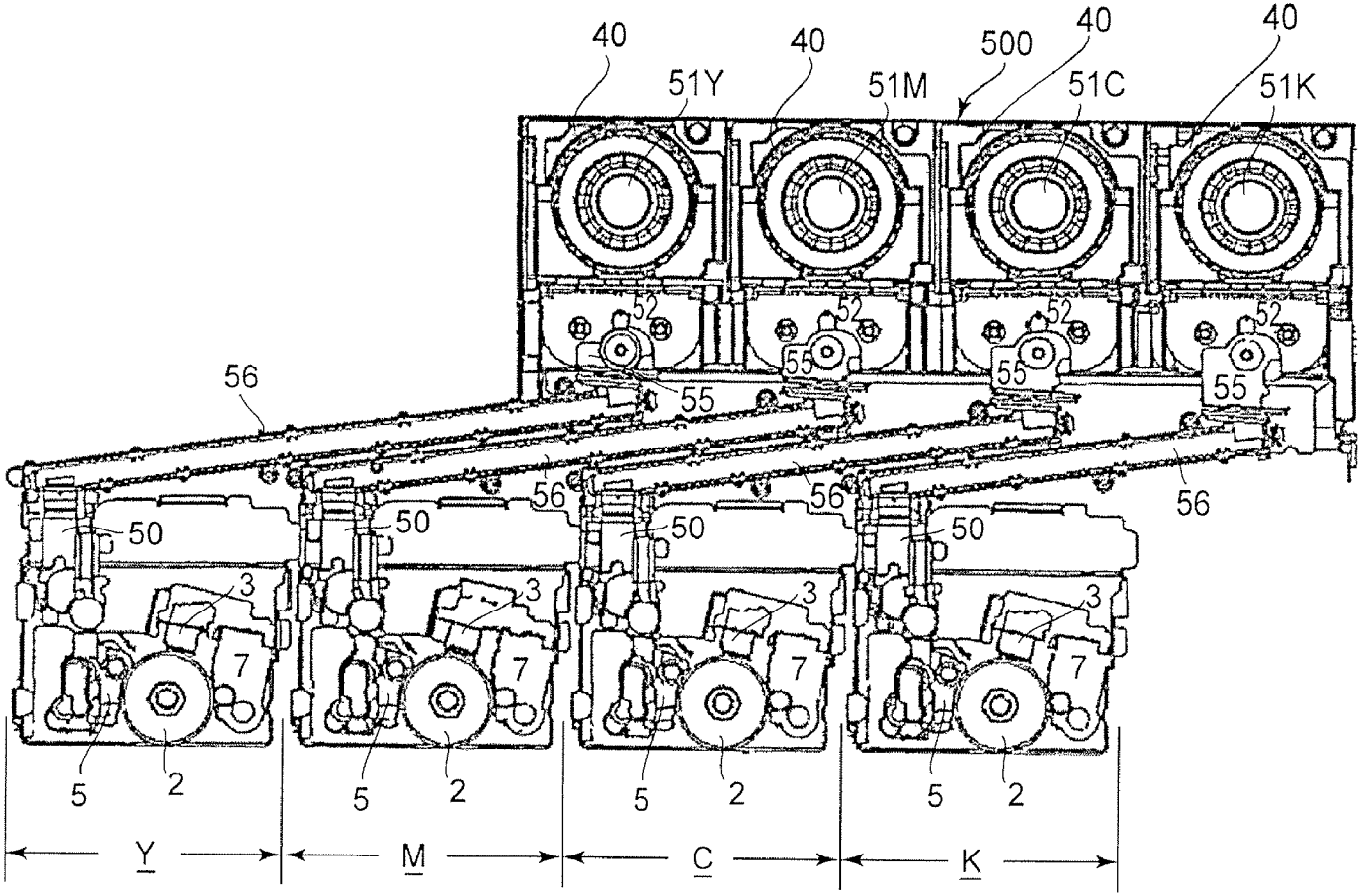
FIG. 2 is a front view of the entirety of the developer dispensing apparatus according to the first embodiment.

The printer 1 has four image forming portions Y, M, C, and K (first to fourth image forming portions, counting from left to right in the drawing), which are in the internal space of the main assembly of the printer, being juxtaposed in parallel. The four image forming portions are the same in structure. Each image forming portion makes up an electrophotographic image forming system, and employs an exposing method which exposes the peripheral surface of an electrophotographic member by scanning the peripheral surface with a beam of laser light. Each image forming portion also has an electrophotographic photosensitive member, which is an image bearing member in the form of a drum 2 (which therefore will be referred to hereafter simply as a drum). Referring to FIGS. 2 and 3, the printer 1 has multiple electrophotographic processing means for processing the drum 2, more specifically, a charging apparatus 3, a laser scanner unit 4, a developing apparatus 5 (developing device), a primary transfer roller 6, a drum cleaning apparatus 7, etc. in the developing apparatuses 5 of the first to fourth image forming portions Y, M, C, and K, yellow (Y), magenta (M), cyan (C), and black (K) color toners (5-10 μm in particle diameter), which are developers, are stored, one-for-one.

The main assembly of the printer 1 has an intermediary transfer belt 8, which is an endless and flexible transferring member formed of a dielectric substance. This belt 8 is supported by three rollers, that is, a driver roller 9, a follower roller 10, and a secondary transfer roller 11, being thereby stretched around the three rollers. In terms of the moving direction of the belt 8, the follower roller 10 is on the upstream side of the first image forming portion Y, whereas the driver roller 9 is on the downstream side of the fourth image forming portion K. Also in terms of the moving direction of the belt 8, the secondary transfer roller 11 is between the driver roller 9 and follower roller 10, and is positioned lower than the two rollers 9 and 10. Further, the outward surface of the portion of the belt 8, which corresponds to the top portion of the belt loop, is in contact with the lowest portion of the peripheral surface of the drum 2 of each of the image forming portions Y, M, C, and K. The printer 1 has a belt cleaning apparatus 12 for cleaning the outward surface of the endless belt 8. The belt cleaning apparatus 12 is on the opposite side of the belt 8 from the follower roller 10.

There are four primary transfer rollers 6, which are on the inward side of the loop which the belt 8 forms. They are kept pressed against the bottom-most portion of the drums 2 of the image forming portions Y, M, C, and K, with the presence of the belt 8 between each drum 2 and corresponding transfer roller 6. The areas of contact between the drums 2 and belt 8 are the primary transfer nips T1.

Further, the printer 1 has a secondary transfer roller 13 (outward transfer roller), which is on the opposite side of the belt 8 from the secondary transfer roller 11 (inward transfer roller). The area of contact between the belt 8 and second transfer roller 13 is the secondary transfer nip T2.

The full-color image forming operation of the printer 1 is as follows: electrical pictorial signals, which represent an intended full-color image, are inputted into the control circuit 100 from the external host apparatus 200. The control circuit 100 controls the entirety of the image forming operation of the printer 1. As the electrical pictorial signals are inputted, the control circuit 100 processes the signals as necessary, and drives the first to fourth image forming portions Y, M, C, and K, with preset timing, to make them perform an image formation sequence. As each image forming portion is driven, the drum 2 of the image forming portion is rotationally driven in the counter-clockwise direction indicated by an arrow mark, at a preset peripheral velocity, and the belt 8 is circularly moved by the driver roller 9 in the clockwise direction indicated by an arrow mark (FIG. 3) at the same velocity as the peripheral velocity of the drum 2. While the drum 2 is rotated, its peripheral surface is uniformly charged to a preset polarity and potential level by the primary charging apparatus 3. Then, the uniformly-charged portion of the peripheral surface of the drum 2 is exposed by a laser scanner unit 4. More specifically, the laser scanner unit 4 scans the uniformly-exposed portion of the peripheral surface of the drum 2 with a beam of laser light L, which it outputs while modulating the beam with the electrical signals outputted by the control circuit 100, that is, the electrical pictorial signals having been processed by the control circuit 100. As a result, an electrostatic latent image, which reflects the pattern of exposure, is effected on the peripheral surface of the drum 2. This electrostatic latent image is developed by the developing apparatus 5 into a toner image.

Through the electrophotographic process described above, a monochromatic toner image is formed on the peripheral surface of the drum 2 of each image forming portion. More specifically, in the first image forming portion Y, a yellow toner image, which corresponds to the yellow component of the intended full-color image, is formed on the peripheral surface of the drum 2. In the second image forming portion M, a magenta toner image, which corresponds to the magenta component of the intended full-color image, is formed on the peripheral surface of the drum 2. In the third image forming portion C, a cyan toner image, which corresponds to the cyan component of the intended full-color image, is formed on the peripheral surface of the drum 2. In the fourth image forming portion K, a black toner image, which corresponds to the black component of the intended full-color image, is formed on the peripheral surface of the drum 2. These monochromatic toner images are formed with preset control timing.

Then, in the primary transfer nip T1 of the first image forming portion Y, the toner image of the color Y formed on the drum 2 is transferred (primary transfer) onto the belt 8 which is being rotationally driven. Next, in the primary transfer nip T1 of the second image forming portion M, the toner image of the color M formed on the drum 2 is transferred (primary transfer) onto the belt 8 which is being rotationally driven, being thereby layered on the above-mentioned toner image of the color Y. Similarly, in the primary transfer nips T1 of the third and fourth image forming portions C and K, the toner images of the colors C and K formed on the drums 2, one-for-one, are sequentially transferred (primary transfer) onto the belt 8 which is being rotationally driven. In other words, four toner images of colors Y, M, C, and K, one-for-one, are sequentially transferred in layers onto the belt 8. As a result, a single unfixed full-color image is synthetically effected on the belt 8.

Regarding the primary transfer of a toner image from the drum 2 to the belt 8 in each transfer nip T1, a preset bias is applied to the primary transfer roller 6 from an electrical power source. As a result, a toner image is electrostatically transferred from the drum 2 onto the belt 8.

Further, in each of the image forming portions Y, M, C, and K, after a given area of the peripheral surface of the drum 2 moves past the primary transfer nip T1, it is cleaned by the drum cleaning apparatus 7; the toner particles remaining on the peripheral surface of the drum 2 after the primary transfer is removed by the drum cleaning apparatus 7. The cleaned area of the peripheral surface of the drum 2 is used for the following image formation cycle.

Then, as the belt 8 is further rotated, the synthetically formed and unfixed full-color toner image on the belt 8 is conveyed by the movement of the belt 8 to the secondary transfer nip T2.

The main assembly of the printer 1 is provided with a recording paper cassette 16, in which multiple sheets of recording medium P are placed in layers on the lifter plate 17 of the cassette 16, being positioned to be fed into the main assembly. While the above-described image forming operation is carried out, the sheets of recording medium P are fed one-by-one into the main assembly by a sheet separating-and-feeding unit 18. After being fed into the main assembly, each recording medium P is conveyed further into the apparatus main assembly by a sheet conveying unit 19, until it reaches a registration unit 20, which includes a pair of registration rollers, by which the recording medium P is registered. Then, the recording medium P is conveyed to the secondary transfer nip T2 in synchronism with the movement of the toner images (full-color image) on the belt 8, and then, is conveyed through the secondary transfer nip T2, while remaining pinched between the belt 8 and secondary transfer roller 13 (inward transfer roller). While the recording medium P is conveyed through the second transfer nip T2, a preset bias is applied to the secondary transfer roller 13 from an electrical power source. As a result, the toner images, different in color, on the belt 8, which make up a single unfixed full-color toner image on the belt 8, are transferred together (secondary transfer) onto the recording medium P.

After moving out of the secondary transfer nip T2, the recording medium P is separated from the belt 8, and is introduced into the fixing apparatus 22 by a recording medium conveying apparatus 21, which is on the immediately upstream side of the fixing apparatus 22 in terms of the recording medium conveyance direction. The fixing apparatus 22 in this embodiment is a fixing apparatus which uses heat and pressure for fixation, and is made up of a pair of rollers, more specifically, a heat roller 22*a* and a pressure roller 22*b*. The recording medium P is introduced into the fixation nip, which is the area of contact between the two rollers 22*a* and 22*b*, and is conveyed through the fixation nip while remaining pinched by the two rollers 22*a* and 22*b*. While the recording medium P is conveyed through the fixation nip, it is subjected to heat and pressure. As a result, the toner images, different in color, on the recording medium P are melted and mixed, being thereby turned into a single full-color image. Then, as the recording medium P and the full-color image thereon cool down, the full-color image becomes fixed to the surface of the recording medium P; a full-color print is obtained.

As the belt 8 is further rotated after the separation of the recording medium P from the belt 8, the portion of the belt 8, from which the recording medium P was separated, is cleaned by the belt cleaning apparatus 12; the toner particles remaining on the belt 8 after the secondary transfer are removed from the belt 8 by the belt cleaning apparatus 12, being therefore prepared for the following cycle of image formation.

When the printer 1 is in the one-sided printing mode, the recording medium P is discharged into a delivery tray 24 by a sheet discharging unit 23 after it comes out of the fixing apparatus 22. When the printer 1 is in the two-sided print mode, the recording medium P is conveyed to a reversing unit 25 after it comes out of the fixing apparatus 22 for the first time, that is, after the formation and fixation of an image on the first of the two surfaces of the recording medium P. In the reversing unit 25, the recording medium P is placed upside down. Then, the recording medium P is conveyed through a recording medium conveying unit 6 for two-sided printing. Then, it is conveyed to the registration unit 20 through the sheet feeding-and-conveying unit 19, for the second time. Then, the recording medium P is conveyed through the second transfer nip T2 for the second time. While the toner images are conveyed through the second transfer nip T2, toner images, different in color, are transferred onto the second surface (reverse side) of the recording medium P. Then, the recording medium P is conveyed through the same recording medium path as that through which it is conveyed when in the one-sided printing mode. Then, the recording medium P, which has images on both of its surfaces at this point, is discharged into the delivery tray 24.

(Developer Dispensing Apparatus)

The developing apparatus 5 of each of the image forming portions Y, M, C, and K uses developer (toner) to develop an electrostatic image on the drum 2. Thus, the developer in the developing apparatus 5 is gradually consumed. Therefore, the developing apparatus 5 needs to be replenished with a proper amount of developer with proper timing. Thus, the printer 1 is provided with a developer dispensing apparatus for replenishing each developing apparatus 5 with developer. Incidentally, in the case of a developing apparatus which uses developer made up of toner and carrier, it is the toner in the developer that is consumed. Therefore, a developing apparatus which uses developer made up of toner carrier needs to be replenished with toner to compensate for the consumed toner.

Figure 1:
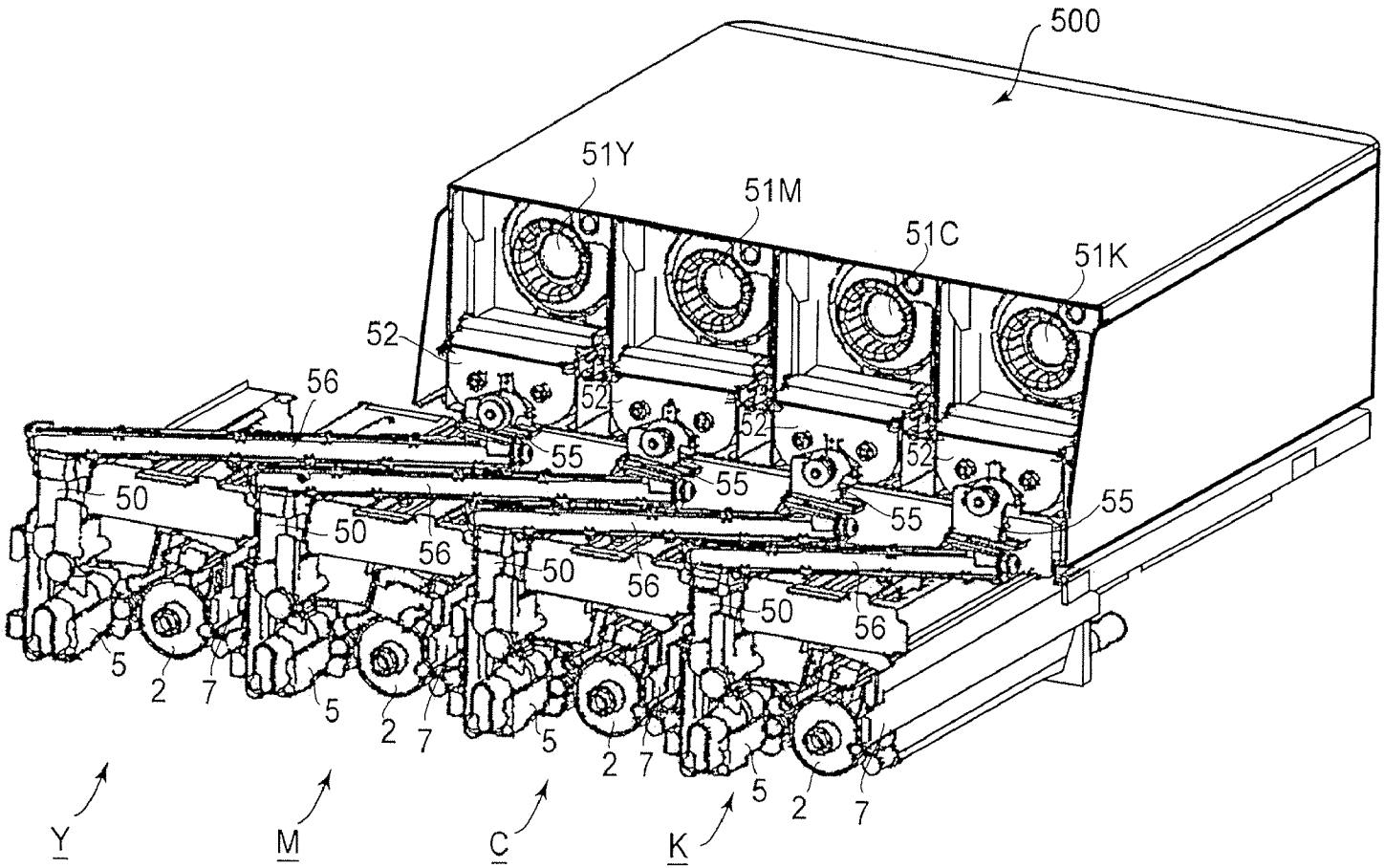
FIG. 1 is a perspective view of the entirety of the developer dispensing apparatus according to a first embodiment of the present invention.

FIG. 1 is a perspective view of the entirety of the developer dispensing apparatus in this embodiment and FIG. 2 is a front view of the entirety of the developer dispensing apparatus.

Referring to FIG. 3, designated by a referential numeral 500 is a developer cartridge storage, which is located in the top portion (or on top) of the main assembly of the printer 1. In the case of the printer 1 in this embodiment, four developer cartridges 51Y, 51M, 51C, and 51K, which contain yellow, magenta, cyan, and black toners, respectively, are replaceably mounted in this developer cartridge storage 500.

With an increase in the operational speed of a printer, the speed at which the developer in a developer cartridge is exhausted also increases, in particular, in an operation in which a large number of prints are continuously yielded. Thus, with the increase in the operational speed of a printer, it is likely for a developer cartridge to be increased in capacity (size). Thus, in consideration of the efficiency with which a user can replace the developer cartridge, the developer cartridge storage 500 has come to be placed in the top portion (on top) of the main assembly of the printer.

The printer 1 is provided with four developer dispensing apparatuses, which deliver developers from the developer cartridge storage 500 to developing apparatuses 5 of the image forming portions Y, M, C, and K, one-for-one. The four developer dispensing apparatuses are the same in structure. Thus, the structure of only one of the four developer dispensing apparatuses will be described.

Figure 4:
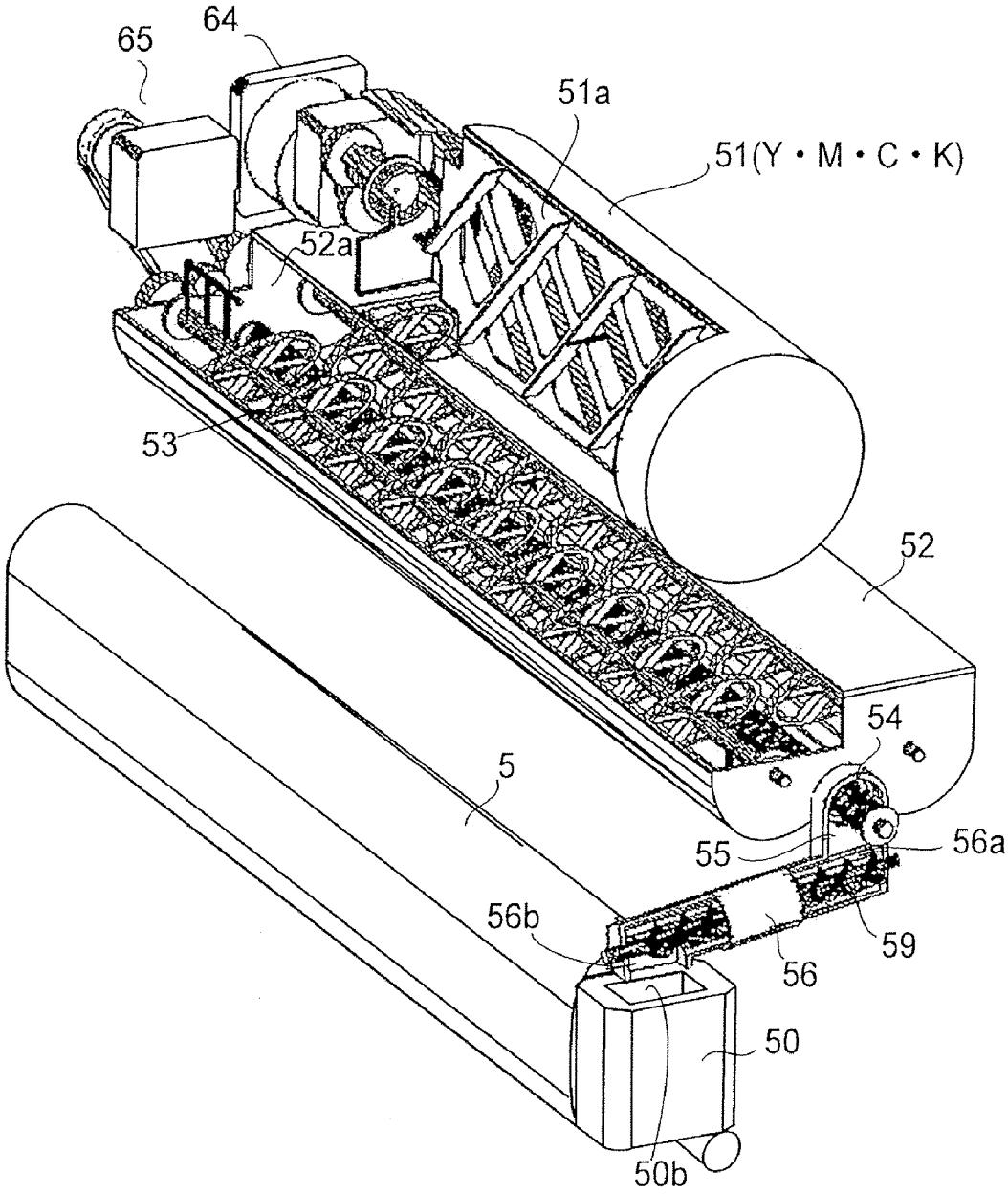
FIG. 4 is a partially cutaway perspective view of the developer dispensing apparatus according to the first embodiment.
Figure 5:
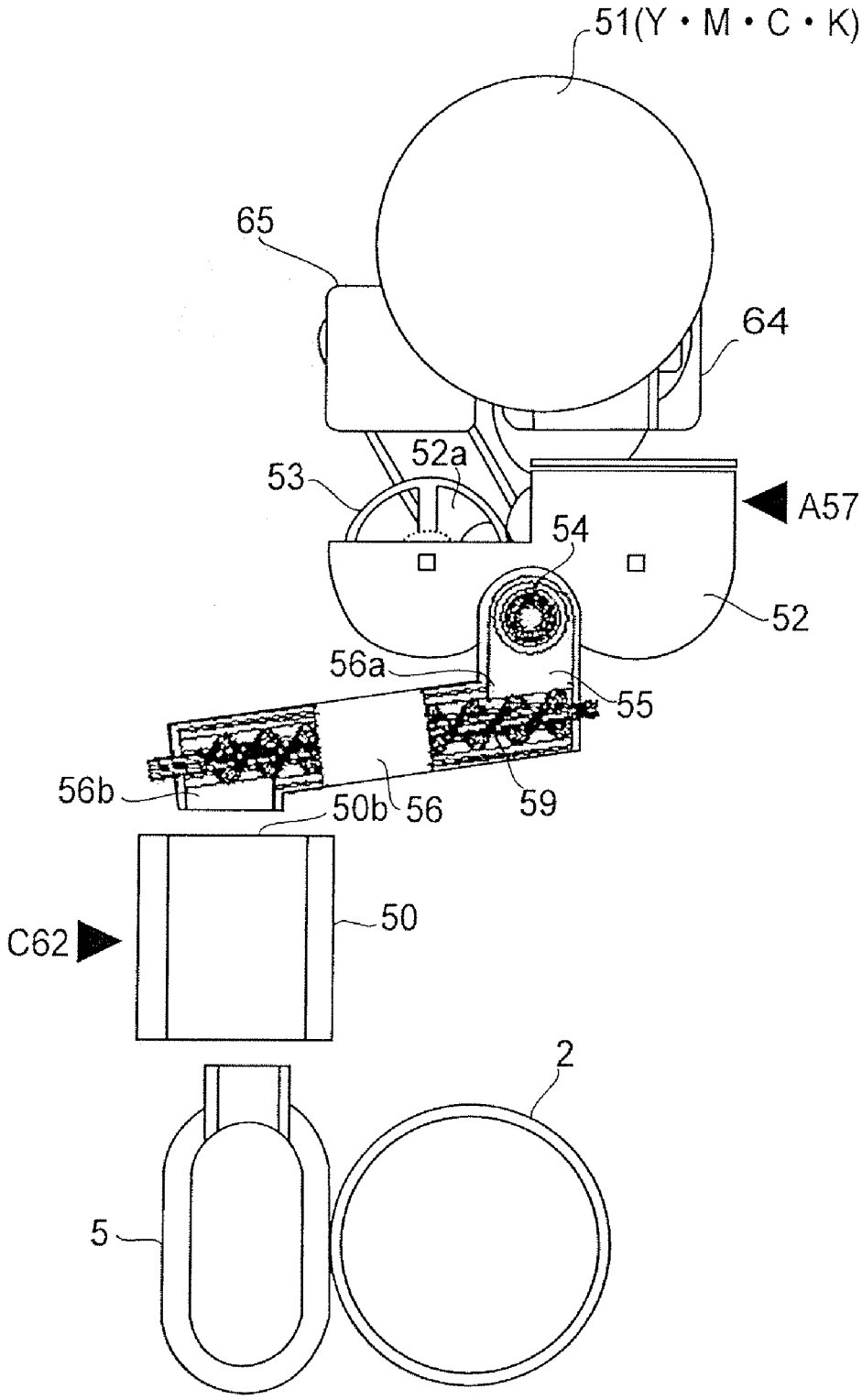
FIG. 5 is a partially cutaway front view of the entirety of the developer dispensing apparatus according to the first embodiment.
Figure 6:
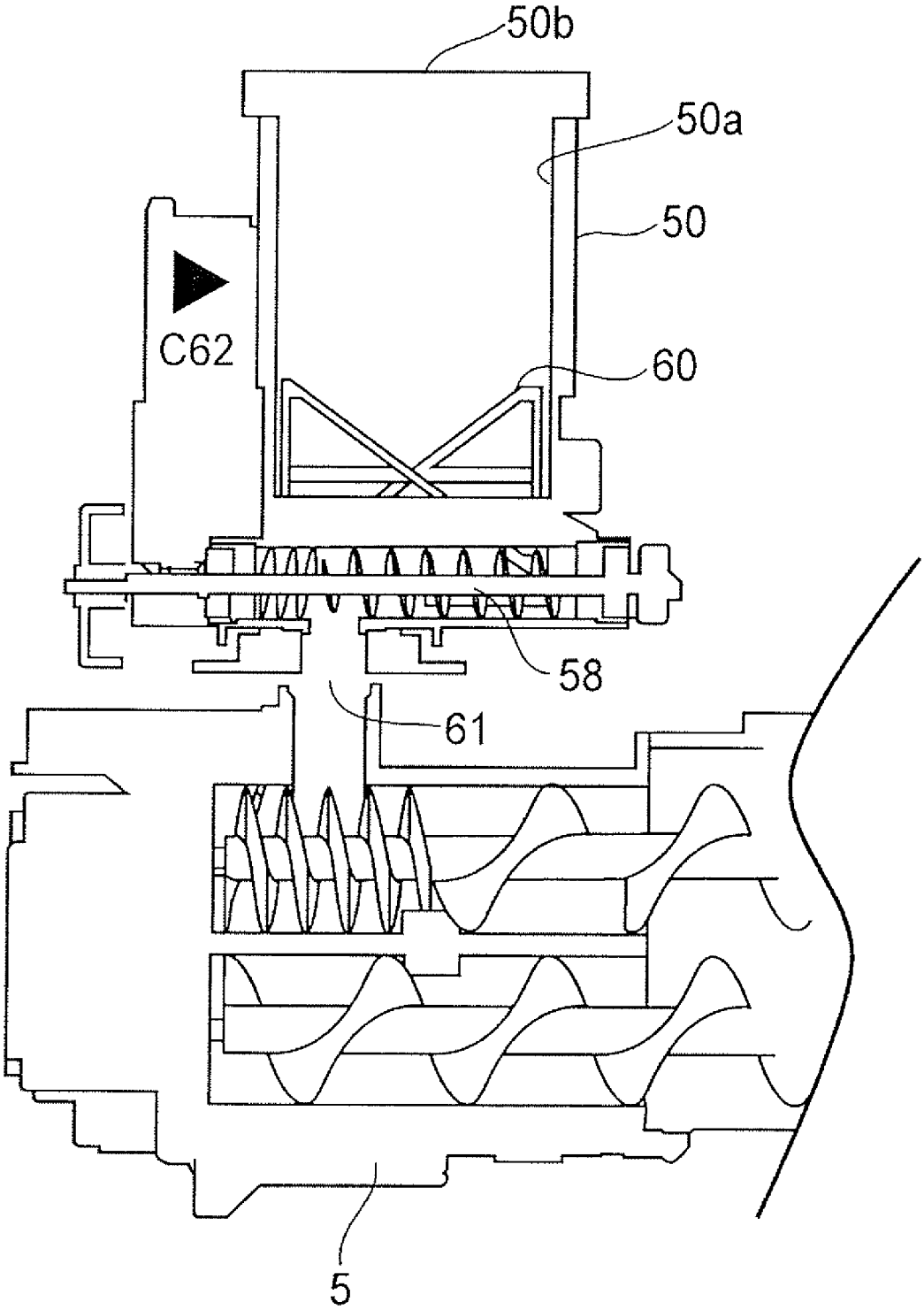
FIG. 6 is a schematic sectional view of the second buffer storage for developer according to the first embodiment.

FIG. 4 is a partially cutaway perspective view of the developer dispensing apparatus which delivers developer from one of the developer cartridges 51 (developer containers) to the corresponding developing apparatus 5. It shows the structure of the developer dispensing apparatus. FIG. 5 is a partially cutaway front view of the entirety of the developer dispensing apparatus which delivers developer from one of the developer cartridges 51 (developer containers) to the corresponding developing apparatus 5. It also shows the structure of the developer dispensing apparatus. FIG. 6 is a partially cutaway schematic side view of the developer dispensing apparatus which delivers developer from one of the developer cartridges 51 (developer containers) to the corresponding developing apparatus 5. It shows the structure of the joint portion between the second portion 50 of the developer dispensing apparatus to the developing apparatus 5.

The developer dispensing apparatus is made up of essentially the developer cartridge storage 500, first portion 52, and second portion 50.

The developer cartridge storage 500 is provided with developer cartridge slots 40, and discharging means 64 and 51*a*. The developer cartridge slots 40 are the slots in which the developer cartridges containing replenishment developer, different in color, are replaceably mountable, one-for-one. The discharging means 64 and 51*a* are the means for discharging the developer (replenishment developer) from a developer cartridge. The developer cartridge storage 500 is also provided with a developer cartridge detecting means, a mechanism for opening or closing the cartridge lid, etc., although they are not shown in the drawings.

The first portion 52 of the developer dispensing apparatus has a first developer storage 52*a*, the capacity of which has a predetermined first value. The first developer storage 52*a* receives the replenishment developer from the developer discharging means 51*a* of the developer cartridge storage 500. The first portion 52 also has a developer amount detecting first means A57 and developer conveying first means 54, 56, and 59. The developer amount detecting means A57 detects the amount of developer in the first developer storage 52*a*. The developer conveying first means 54, 56, and 59 conveys the replenishment developer out of the first developer storage 52*a*.

The second portion 50 of the developer dispensing apparatus has a second developer storage 50*a* which stores the replenishment developer which the first developer conveying means 54, 56, and 59 conveys to the second developer storage 50*a*. It also has a developer conveying second means 58 and a developer amount detecting second means C62. The developer conveying second means 58 conveys the replenishment developer in the second developer storage 50*a*, to the corresponding developing apparatus 5, in response to the developer consumption by the developing apparatus 5. The developer amount detecting second means C62 detects the amount of developer in the second developer storage 50*a*.

Figure 7A:
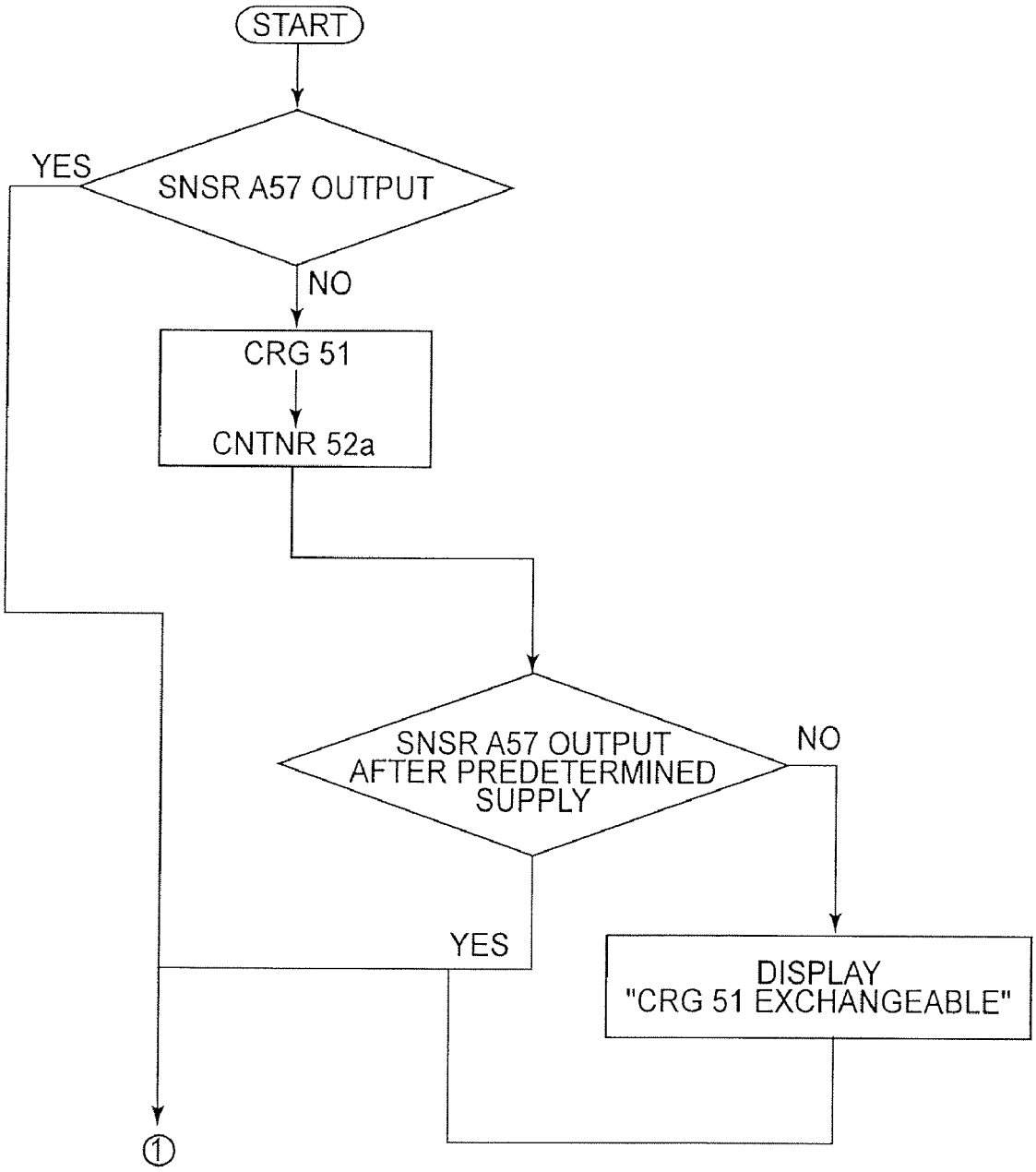
FIG. 7A is a flowchart (No. 1) of the developer dispensation sequence in the first embodiment.
Figure 7B:
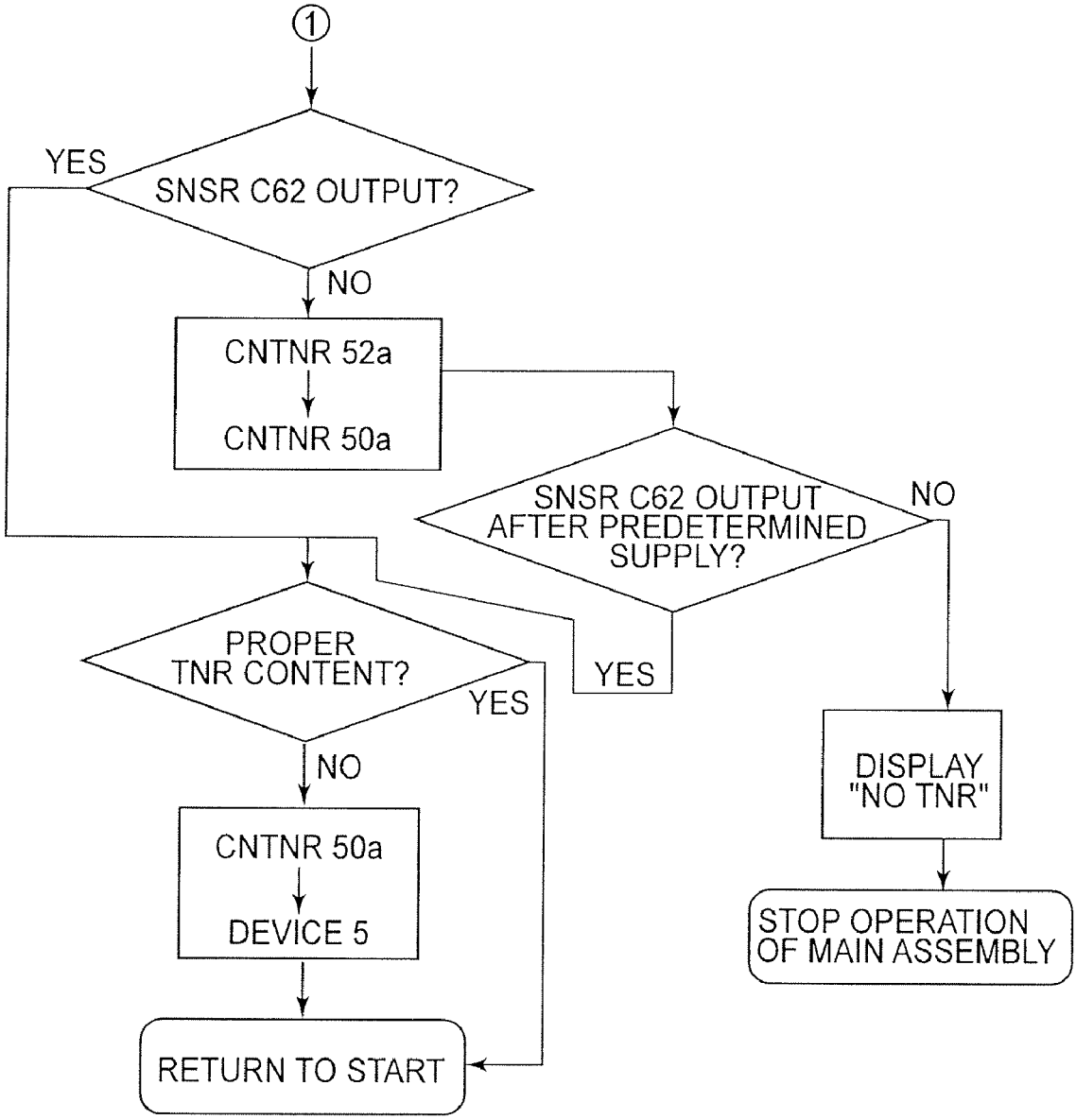
FIG. 7B is a flowchart (No. 2) of the developer dispensation sequence according to the first embodiment.

The structure of the developer dispensing apparatus shown in FIGS. 1, 2, and 4-6, will be described along with the operational sequence of the developer dispensing apparatus, with reference to FIGS. 7A and 7B which are flowcharts of the operational sequence of the developer dispensing apparatus. The developer dispensing sequences given in FIGS. 7A and 7B are carried out by the control circuit 100, which is a controlling means.

In the internal space of the cylindrical developer cartridge 51, the replenishment developer (toner) is stored. The developer cartridge 51 is inserted into the predetermined developer cartridge slot of the developer cartridge storage 500, and is set therein, by a user.

The control circuit 100 drives a developer cartridge driving motor 64 until a developer sensor A57 (developer amount detecting first means) determines whether or not the amount of developer in the first developer storage 52*a* of the first portion 52 of the developer dispensing apparatus is the same or greater than a preset value. As the motor 64 is driven, a paddle 51*a* is rotated by the motor 64, whereby the replenishment developer in the developer cartridge 51 is delivered to the first developer storage 52*a*. Incidentally, the developer cartridge driving motor 64 and paddle 51*a* make up the discharging means for discharging the replenishment developer in the mounted developer cartridge 51.

That is, the developer dispensing apparatus is controlled so that it delivers the replenishment developer from the developer cartridge 51 to the first developer storage 52*a* to ensure that the amount of developer in the first developer storage 52*a* remains the same as, or greater than, a predetermined first value.

In other words, unless the developer cartridge 51 in the developer cartridge storage 500 is empty, the control circuit 100 causes the developer dispensing apparatus to discharge developer from the developer cartridge 51, in response to the signal from the developer sensor A57, until the first developer storage 52*a* becomes full. Here, being full means that the amount of the developer in the first developer storage 52*a* is the same as, or greater than, the above-mentioned predetermined value.

When the developer sensor A57 does not detect the first predetermined amount of developer, in the first developer storage 52*a* even through the operation for discharging developer from the developer cartridge 51 to the first developer storage 52*a* is carried out for a preset length of time, the control circuit 100 determines that the developer cartridge 51 is empty. Then, it displays, on the displaying means of the operation panel 101 (control panel) of the main assembly of the printer, the message which informs the user that the developer cartridge 51 in the developer storage portion 500 is ready to be replaced.

The first portion 52 of the developer dispensing apparatus is provided with a developer conveyance pipe 56 which connects the first developer storage 52*a* to the second developer storage 50*a* of the second portion 50 of the developer dispensing apparatus. Further, the first portion 52 of the developer dispensing apparatus is provided with a pair of developer discharging screws 54 and 59, which are in the first developer storage 52*a* and developer conveyance pipe 56, respectively. The above-mentioned developer conveyance pipe 56 and developer discharging screws 54 and 59 make up the developer conveying first means which discharges the replenishment developer in the first developer storage 52*a* from the first developer storage 52*a*.

The control circuit 100 detects the amount of the developer in the second developer storage 50*a* of the second portion 50 of the developer dispensing apparatus, through the developer sensor C62 which is the second means for detecting the developer amount. When it is detected by the developer sensor C62 that the amount of developer in the second developer storage 52*a* is less than the predetermined second value, the control circuit 100 rotationally drives the developer discharging screws 54 and 59, with the use of driving means (unshown). As the screws 54 and 59 are driven, the replenishment developer in the first developer storage 52*a* is moved out of the first developer storage 52*a* through the developer outlet 55, and enters the developer inlet 56*a* of the developer conveyance pipe 56. Then, the developer is conveyed to the second portion 50 of the developer dispensing apparatus through the developer conveyance pipe 56.

That is, the developer is conveyed, in response to the signal from the developer sensor C62, from the first portion 52 of the developer dispensing apparatus to the second portion 50 of the developer dispensing apparatus, by the developer conveying first means 54, 56, and 59 so that the predetermined second amount of developer accumulates in the second developer storage 50*a*.

The amount of the developer in the developing apparatus 5 is detected by a developer amount detecting means (unshown). Then, the information regarding the detected developer amount is fed back to the control circuit 100. As it is detected by the developer amount detecting means that the amount of developer in the developing apparatus 5 fell below a preset value, the control circuit 100 activates the driving means (unshown) to replenish the developing apparatus 5 with the use of a developer conveying screw 58 in the second portion 50 of the developer dispensing apparatus. This operation for replenishing the developing apparatus 5 with developer is carried out so that the amount of developer in the developing apparatus 5 remains stable roughly at a predetermined level. The above-described developer conveying screw 58 is the developer conveying second means, which delivers the replenishment developer toner in the second developer storage 50*a* to the developing apparatus 5, in response to the developer consumption by the developing apparatus 5.

As described above, there is the predetermined second amount of developer in the second developer storage 50*a* of the second portion 50 of the developer dispensing apparatus. Therefore, the amount by which developer is delivered to the developing apparatus 5 remains stable.

If the developer sensor C62 fails to detect the body of developer in the second developer storage 50*a* even though the developer is conveyed from the first portion 52 of the developer dispensing apparatus to the second portion 50 of the developer dispensing apparatus for a preset length of time, it may be impossible to keep stable the amount of developer in the developing apparatus 5. Thus, at this point in time, the control circuit 100 displays on the displaying means of the control panel 101, a message that informs a user that the developer has been used up. Then, it stops the printing operation which is being carried out by the main assembly of the printer.

The first amount (referential value) for the developer in the developer storage 52*a* of the first portion 52 of the developer dispensing apparatus is set to be greater than the capacity (amount of developer storable in developer cartridge) of the developer cartridge 51. In this embodiment, the developer capacity of the first developer storage 52*a* is roughly 1.5 times that of the developer cartridge 51. Therefore, when the first developer storage 52*a* is empty as it is when the printer 1 was put to use for the first time, the second developer cartridge 51 can be mounted after the entirety of the developer in a first brand-new developer cartridge 51 is discharged into the first developer storage 52*a*. In a case where the printer is started when the printer is in the above-described condition, the amount of the developer in the main assembly of the printer equals twice the capacity of the developer cartridge 51.

Therefore, in a case where a user starts a printing operation when the printer is in the above-described state, and continues the printing operation without replenishing the printer with developer (toner), first, the developer cartridge 51 becomes empty, and then, the first developer storage 52*a* becomes empty. Further, until it becomes impossible to keep the amount of developer in the second developer storage at the preset level or higher, it does not occur that the printing operation is interrupted due to the developer shortage; in other words, the printing operation can be continued.

Obviously, the printing operation stops as soon as the recording medium cassette 16 runs out of recording medium P. However, generally, this problem can be prevented by providing a printer with additional sheet feeder decks to ensure that a necessary number of sheets of recording medium (paper) can be uninterruptedly fed into the main assembly of the printer.

Further, even when the printer is used for an ordinary purpose, developer is discharged from the developer cartridge 51 to the first developer storage 52*a* until the developer sensor A57 of the first portion 52 of the developer dispensing apparatus detects developer. Therefore, even in the worst case, the printer can be uninterruptedly operated for the length of time it takes to consume 1.5 times a developer cartridge full of developer (first developer storage (52*a*) full of developer+ amount of developer remaining in developer cartridge 51).

If a user wants to extend the length of time the printer can be uninterruptedly operated, because a user cannot replenish the printer with developer for some reason or other, all that is necessary for the user to do is to replace the developer cartridge 51 in the developer cartridge storage 500 with a brand-new one before starting a printing operation. With the printer fitted with a brand-new developer cartridge 51, the printer can be uninterruptedly operated for the length of time it takes to consume 2.5 times a developer cartridge full of developer (first developer storage (52*a*) full of developer+developer cartridge full of developer).

As described above, the developer cartridge storage 500 is in the top portion (on top) of the main assembly of the printer. Therefore, developer is conveyed through the developer conveyance pipe 56 from the developer cartridge storage 500 to the second portion 50 of the developer dispensing apparatus, which is in the vicinity of the developing apparatus 5.

More concretely, the first portion 52 of the developer dispensing apparatus is provided with an agitator 53 and the developer conveying screw 54, which are in the first potion 52. As this screw 54 is rotated by the driving means (unshown), the developer in the first developer storage 52*a* is discharged by the screw 54 through the outlet 55, with which the front side of the first developer storage 52*a* is provided. Reference numeral 65 depicts the means for driving the agitator 53. The discharged developer enters the developer conveyance pipe 56 through the developer inlet 56*a*, and is conveyed through the pipe 56 by the developer conveying screw 59 in the pipe 56. Then, the developer is discharged from the pipe 56 through the developer outlet 56*b*, and is sent to the developer entrance 50*b* of the second portion 50 of the developer dispensing apparatus.

Referring to FIG. 6, the second portion 50 of the developer dispensing apparatus is provided with a stirring member 60 and a developer conveying screw 58. The developer having entered the second portion 50 of the developer dispensing apparatus through the developer entrance 50*b* is temporarily stored in the second developer storage 50*a*, in which the stirring member 60 is located. Then, the developer in the second developer storage 50*a* is delivered, as necessary, through the joint 61, to the developing apparatus 5, by the developer conveying screw 58, as the developer conveying second means, which is controlled by the control circuit 100, in response to the developer consumption by the developing apparatus 5.

The second portion 50 of the developer dispensing apparatus is provided with the developer sensor C62. The developer is delivered from the above-mentioned first portion 52 of the developer dispensing apparatus to the second portion 50 of the developer dispensing apparatus, through the developer conveyance pipe 56 until the developer sensor C62 detects the developer. Therefore, the amount of developer in the second developer storage 50*a* is not affected by the problem that the amount by which developer is discharged from a developer cartridge of a large capacity is significantly affected by the amount of developer remaining in the developer cartridge, and the problem that the amount by which developer is delivered to the second developer storage 50*a* is affected by the length of the developer conveyance pipe 56. In other words, the amount of developer in the second developer storage 50*a* can be kept at the predetermined second value. Therefore, the developing apparatus 5 is reliably supplied with the developer from the second developer storage 50*a*.

Further, the second portion 50 of the developer dispensing apparatus is structured as described above, and its operation is controlled as described above. Therefore, the amount by which developer is stored in the second developer storage 50*a* is set to a value smaller than the capacity of the first developer storage 52*a* and the capacity of the developer cartridge 51, while extending the length of time the printer can be uninterruptedly operated.

The developer dispensing apparatus is structured so that the capacity (predetermined first value) of the first developer storage 52*a* is greater than that of the developer cartridge 51. Therefore, when the message, which indicates that the developer cartridge 51 in the developer cartridge slot is ready to be replaced, is being displayed by the displaying means 101, a user can load the printer with the sum of a developer cartridge full of developer and a first developer storage full of developer (no less than developer cartridge full of developer), in order to extend the length of time the printer can be uninterruptedly operated so that even when a large number of copies are printed with the use of a high speed printer, the printer does not stop because of developer depletion. Therefore, the printer in this embodiment can reduce the amount of work which a user is to perform.

Further, the developer cartridge storage of a large capacity, and the first developer storage 52*a* which is greater in capacity than a single developer cartridge, are located on top of, or in the top portion, of the main assembly of the printer, in order to make it easier for a user to replace the developer cartridge (s). This setup makes it necessary for the developer to be conveyed to the image forming portions, through the relatively long developer conveyance passage. However, the second portion 50 of the developer dispensing apparatus is located in the vicinity of the developing apparatus 5. Therefore, it is possible to reduce the effects of the problem that the amount by which developer is discharged from the developer cartridge 51 (which is large in capacity) is nonuniform because it is affected by the amount of the developer remaining in the developer cartridge 51, and the problem that the amount by which developer is delivered to the developing apparatus 5 is unstable because the developer has to be conveyed a long distance to be delivered to the developing apparatus 5.

Further, the second portion 50 of the developer dispensing apparatus is structured so that the capacity (predetermined second value) of the second developer storage 50*a* is smaller than the capacity (predetermined first value) of the first developer storage 52*a*, and the capacity of the developer cartridge 51. Further, the second portion 50 of the developer dispensing apparatus is provided with the developer amount detecting means C62 for detecting whether or not the amount of the developer in the second portion 50 roughly equals the predetermined second value. Therefore, the printer can uninterruptedly form images until the amount of the developer in the second developer storage 50*a*, which is detected by the developer amount detecting means C62, falls below the predetermined second value. That is, the controller 100 allows the printer to uninterruptedly form images until the amount of the developer in the second developer storage 50*a* falls below the predetermined second value.

That is, as long as developer is in the developer cartridge 51, the control circuit 100 controls the operation of the developer discharging means 51*a* (paddle), in response to the results of the developer amount detection by the developer amount detecting first means A57, so that the amount of the developer in the first developer storage 52*a* becomes the same as, or more than, the predetermined first value. Further, it carries out the developer dispensing sequence, in which it controls the operation of the developer conveying first means 54, 56, and 59, in response to the results of the developer detection by the developer amount detecting second means C62, so that the amount of the developer in the second developer storage 50*a* becomes the same as, or more than the predetermined second value. Then, even if the developer cartridge 51 in the developer cartridge slot becomes depleted of the replenishment developer, and the amount of the replenishment developer in the first developer storage 52*a* becomes less than the predetermined first value, the image forming operation can be continued until the amount of the developer in the second developer storage 50*a* becomes less than the predetermined second value.

As described above, the first developer storage 52*a* is made greater in capacity than the developer cartridge 51, and developer is delivered from the developer cartridge 51 to the first portion 52 of the developer dispensing apparatus so that the first developer storage 52*a* is always full of developer. Therefore, a user can store developer in the main assembly of the printer by the amount as large as the value equal to the sum of the capacity of the first developer storage 52*a* and the capacity of the developer cartridge 51, making it possible to extend the length of time the printer can be uninterruptedly operated. Further, the second portion 50 of the developer dispensing apparatus, which is relatively small in developer capacity is positioned between the first portion 52 of the developer dispensing apparatus and developing apparatus 5. Therefore, the amount by which developer is delivered to the developing apparatus 5 per developer dispensing operation can be made uniform even though the developer dispensing apparatus is provided with the developer delivering portion of a substantial size.

To summarize, developer is conveyed from the developer cartridge 51—first developer storage 52*a*—second developer storage 50*a* (subordinate hopper)—developing apparatus 5. The developer dispensing apparatus is structured so that in terms of developer capacity, the first storage 52*a*<developer cartridge 51<second developer storage 50*a*, and the operational sequence for delivering developer to the first developer storage 52*a* to keep the first developer storage 52*a* filled with the preset amount developer is prioritized. Since the first developer storage 52*a* is greater in developer capacity than the developer cartridge 51, developer can be stored in the printer by an amount equal to the sum of the developer capacity of the first developer storage 52*a* and capacity of the developer cartridge 51, that is, an amount greater than twice the developer capacity of the developer cartridge 51. Developer is delivered from the first portion 52 of the developer dispensing apparatus, through the developer conveyance path, to the second portion 50 of the developer dispensing apparatus, which is in the vicinity of the developer entrance (inlet) of the developing apparatus 5, and then, is delivered from the second portion 50 to the developing apparatus 5, based on the signal from an ATR sensor, video count, or the like information. Therefore, the developer cartridge 51 in the developer cartridge storage 500 can be replaced even when the printer is operating. Further, not only is developer in the developer cartridge 51 in the developer cartridge storage 500, but also, it is in the first developer storage 52*a*. Therefore, the printer in this embodiment is greater in the length of time it can be uninterruptedly operated, and also, is more stable in the amount by which developer is delivered to the developing apparatus 5 per developer dispensing operation.

Embodiment 2

Next, referring to FIGS. 8, 9A, and 9B, the second embodiment of the present invention will be described.

Figure 8:
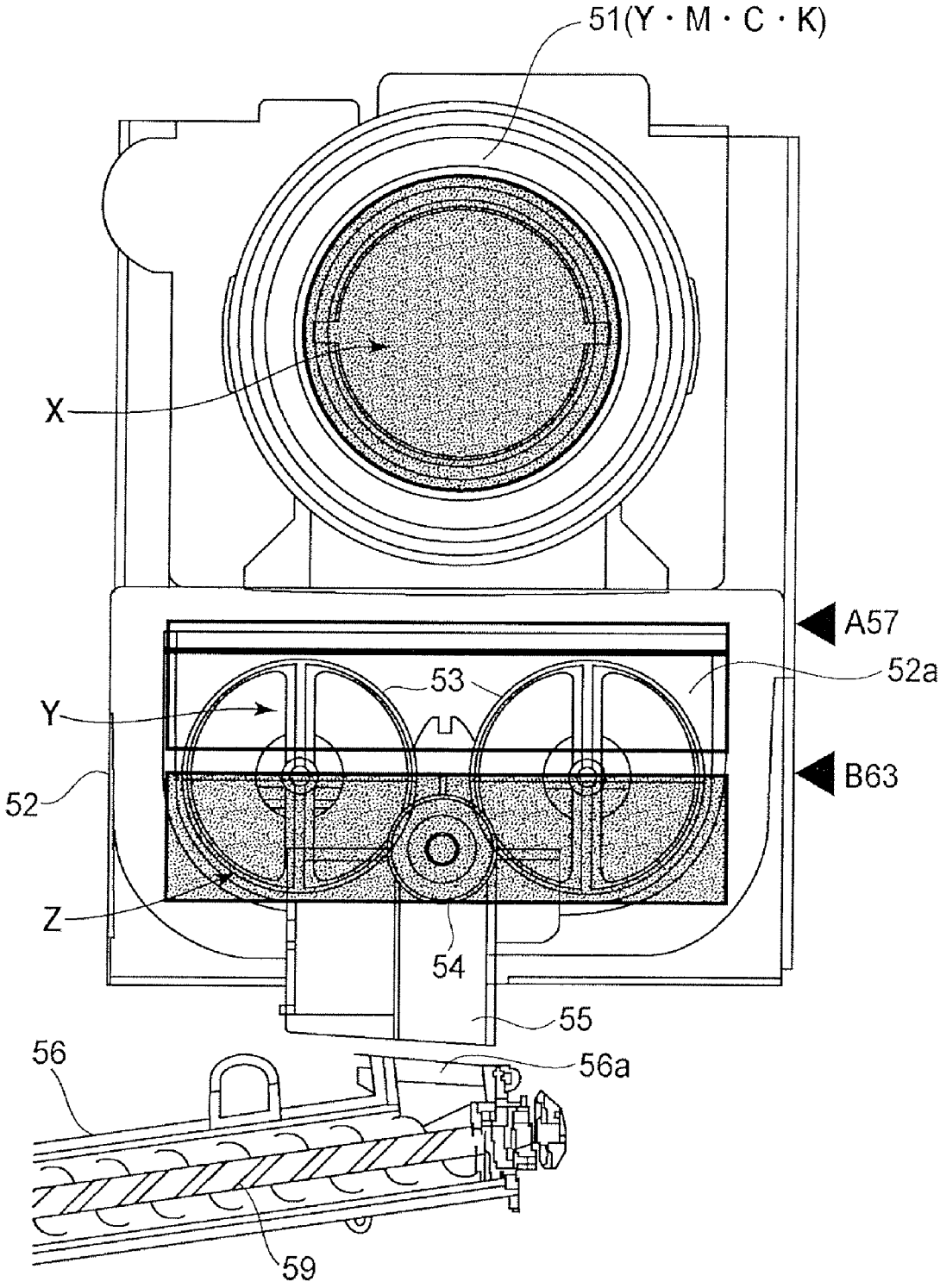
FIG. 8 is a schematic sectional view of the first buffer storage for developer according to a second embodiment of the invention.
Figure 9A:
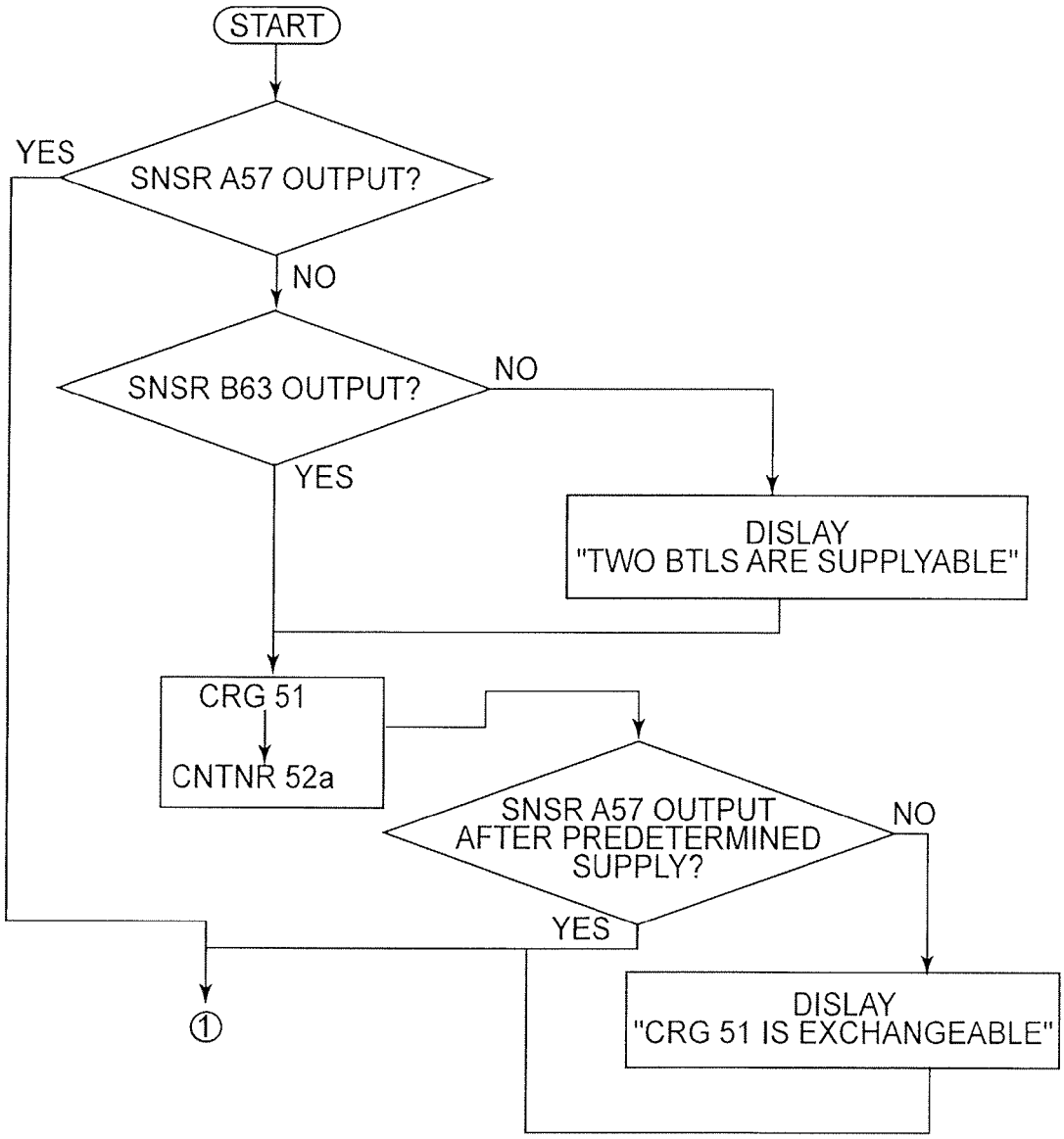
FIG. 9A is a flowchart (No. 1) of the developer dispensation sequence according to the second embodiment.
Figure 9B:
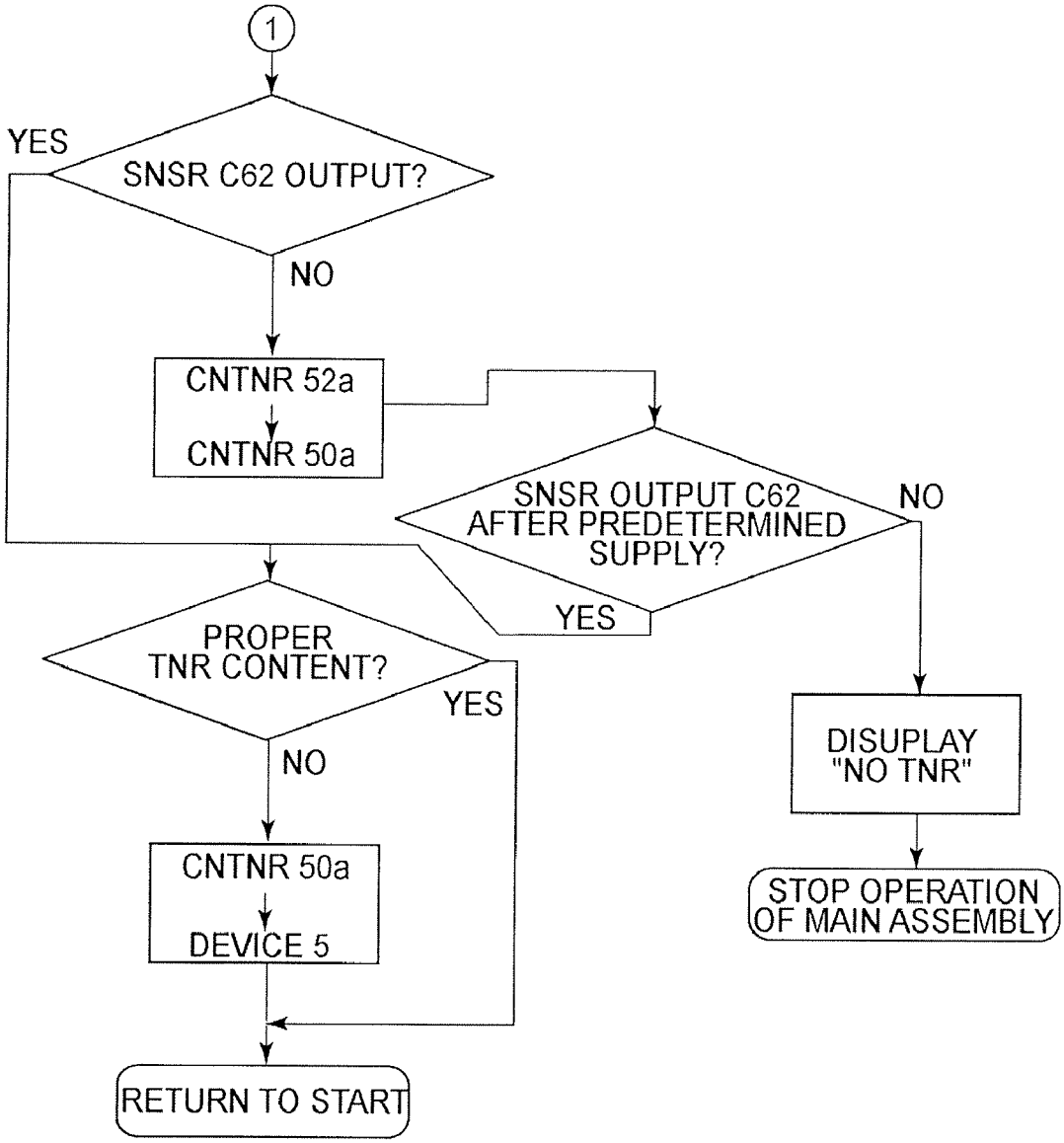
FIG. 9B is a flowchart (No. 2) of the developer dispensation sequence according to the second embodiment.

FIG. 8 is a schematic sectional view of the first portion 52 of the developer dispensing apparatus in the second embodiment of the present invention. Incidentally, the structural components in this embodiment, which are the same in function as those in the above-described first embodiment, are given the same reference numerals and characters as those given to the corresponding components as in the first embodiment, and will not be described here.

The main assembly of the printer (image forming apparatus) in this embodiment is different from that in the first embodiment in that the first portion 52 of its developer dispensing apparatus is different in structure from the corresponding portion in the first embodiment. That is, the first developer storage 52*a* of the first portion 52 of the developer dispensing apparatus, shown in FIG. 8, is roughly twice in developer capacity as the developer cartridge 51. Further, the first developer storage 52*a* is provided with a developer sensor B63 (developer amount detecting third sensor), in addition to the developer sensor A57. The developer sensor B63 is positioned so that it is enabled to determine whether or not the amount of the empty space in the first developer storage 52*a* is the same as the developer capacity of the developer cartridge 51.

The control circuit 100 uses this developer sensor B63 to determine whether or not the empty space (designated by referential letter Y in FIG. 8) in the first developer buffer 52 is large enough to accommodate the entire amount of developer in a brand-new developer cartridge 51. If it is determined that the empty space in the first developer buffer 52 is large enough, the controller 100 displays on the displaying means of the control panel 101 of the main assembly of the printer, the message which indicates to a user that the printer can be replenished with two developer cartridges full of developer.

That is, the first portion 52 of the developer dispensing apparatus is provided with the developer amount detecting third means B63 which determines the state of the developer storage space in the first developer storage 52*a*, that is, whether or not the empty space in the first developer buffer 52 is larger than the developer capacity of the developer cartridge 51. Based on this information, the control circuit 100 displays on the displaying means of the control panel 101 of the main assembly of the printer, the results of the detection by the developer sensor B63, that is, the message which indicates to a user that the printer may be filled with two developer cartridge full of developer.

If this message is displayed, a user is to replace the developer cartridge 51 in the developer cartridge storage with the first brand-new developer cartridge 51. Then, the control circuit 100 begins the operation for discharging developer from the first replacement developer cartridge 51 into the first portion 52 of the developer dispensing apparatus, and continues the operation until the developer sensor B63 detects developer, that is, until the control circuit 100 determines that the first developer storage 52*a* is full, as shown by FIGS. 9A and 9B, which are flowcharts of the developer dispensing sequence.

The first portion 52 of the developer dispensing apparatus is continuously filled until the sum of the developer remainder (Z in FIG. 8) in the first portion 50 and the total amount of developer from the first replacement developer cartridge 52 fills up the first developer storage 52*a*. Then, the user is informed that the first brand-new replacement cartridge in the developer cartridge slot is ready to be replaced with the second replacement developer cartridge 51. Therefore, immediately after the completion of this developer dispensing operation, the total amount of developer in the main assembly of the printer, that is, the sum of the entire amount of first developer storage 52*a* (Z+Y in FIG. 8) and the amount of developer in the second brand-new replacement developer cartridge, is enough to uninterruptedly form images for a length of time equivalent to three developer cartridge full of developer.

In this embodiment, the total capacity (predetermined first amount) of the first developer storage 52*a* is roughly twice the developer capacity of the developer cartridge 51. However, it may be adjusted according to the size of a printer, and the capacity of the developer cartridge employed by the printer. Further, for best efficiency, the value to which the capacity of the first developer storage 52*a* is set is desired to be an integer multiple, for example, three times, four times, and the like. In other words, the value to which the capacity of the first developer storage 52*a* is set is desired to be an integer multiple, which is greater than twice the capacity of the developer cartridge 51. With the employment of this arrangement, the main assembly of the printer can be fully loaded with developer by carrying out only once the operation for replacing the developer cartridge, and therefore, it is possible to reduce the amount of work to be performed by a user to replenish the printer with developer.

Embodiment 3

Next, the third embodiment of the present invention will be described.

Figure 10A:
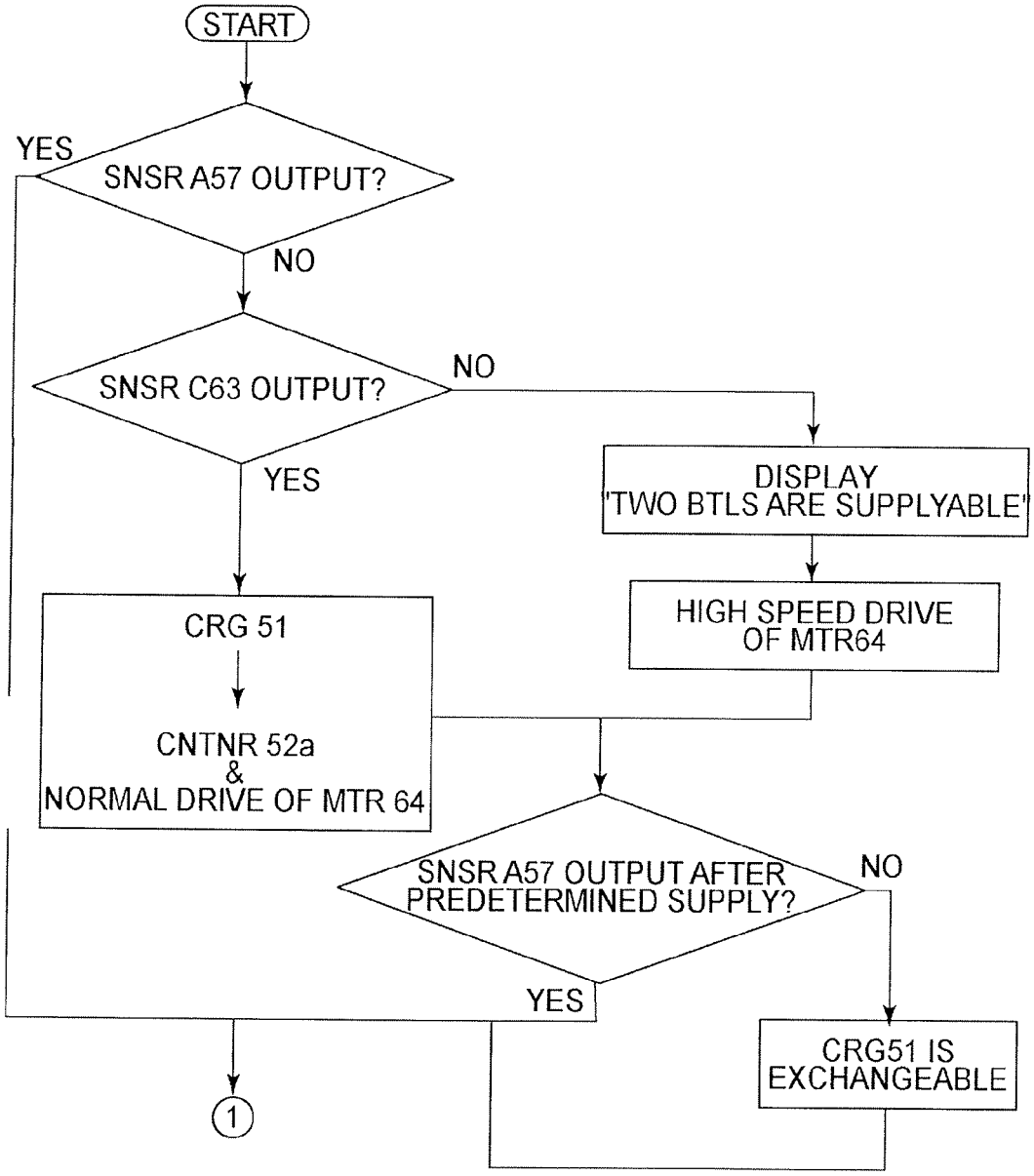
FIG. 10A is a flowchart (No. 1) of the developer dispensation sequence according to a third embodiment of the invention.
Figure 10B:
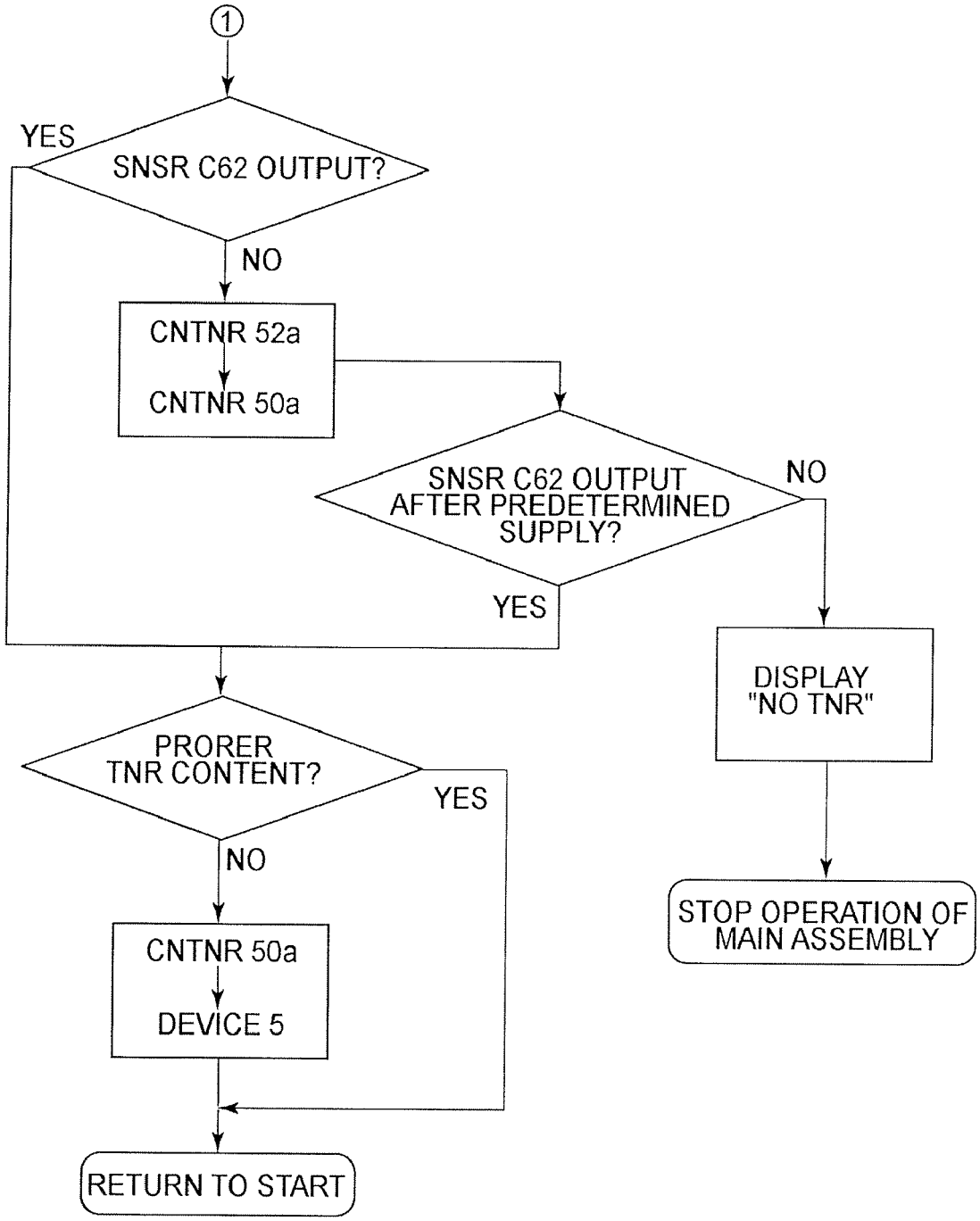
FIG. 10B is a flowchart (No. 2) of the developer dispensing sequence according to the third embodiment.

In terms of printer structure, this embodiment is the same as the second embodiment. The developer delivering operation in this embodiment, however, is carried out as shown by FIG. 10 which is a flowchart of the developer dispensing sequence in this embodiment.

In the case of the printer in this embodiment, which is the same in structure as that in the second embodiment, if it is determined that the empty space in the first developer storage 52*a* has become larger than the developer capacity of the developer cartridge 51, the control circuit 100 makes the speed at which developer is discharged by the developer discharging means 54, 56, and 59, faster than the normal speed.

Normally, as the developer in the first developer storage 52*a* of the first portion 52 of the developer dispensing apparatus is consumed by a printing operation, it eventually becomes impossible for the developer in the first developer storage 52*a* of the first portion 52 of the developer dispensing apparatus to be detected by the developer sensor A57. As it becomes impossible for the developer in the first developer storage 52*a* to be detected by the developer sensor A57, the motor 64 for driving the developer cartridge is driven. As a result, the developer in the developer cartridge 51 is discharged into the first developer storage 52*a*. Unless the printing operation has been continued with the developer cartridge 51 remaining empty, this operation for discharging the developer ends within a short length of time, making it unnecessary to drive the motor 64 at a high speed. However, if a printing operation is continued without replacing the developer cartridge 51, it is detected by the sensor B63 that the empty space Y in the first developer storage 52*a* has become large enough to accommodate a developer cartridge full of developer. Then, the message indicating that the main assembly of the printer can take two developer cartridges full of developer is displayed on the monitor of the control panel 101 of the main assembly of the printer. If the developer cartridge 51 in the developer cartridge slot is replaced with a brand-new developer cartridge while the main assembly of the printer is in this condition, the developer in the brand-new developer cartridge is continuously discharged until the developer sensor A57 detects the body of developer in the first developer storage 52*a*, that is, until the entirety of the developer in the replacement developer cartridge 51 is discharged into the first developer storage 52*a*.

In a case such as the above-described one, the motor 64 is driven at a higher speed than that at which the motor 64 is driven in a normal developer discharging operation, reducing thereby the length of time necessary for the main assembly of the printer to become ready for the mounting of the second brand-new developer cartridge 51. With the length of time necessary for the main assembly of the printer to become ready for the mounting of the second brand-new developer cartridge 51 reduced, it takes less time for a user to complete the operation for replenishing the printer with developer.

The image forming apparatuses in the first to third embodiments have four image forming portions juxtaposed in tandem. However, the present invention is also compatible with an image forming apparatus having multiple switchable developing apparatuses and a single photosensitive drum, and a monochromatic image forming apparatus, which is obvious.

Further, the image forming method of an image forming apparatus, with which the present invention is compatible, is not limited to an electrophotographic process which employs a photosensitive member. That is, the present invention is also compatible with the electrostatic recording process and magnetic recording process, which use an electrostatically recordable dielectric member and a magnetically recordable magnetic member, respectively, as an image bearing member.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 023042/2007 filed Feb. 1, 2007, which is hereby incorporated by reference.

What is claimed is:

1. An image forming apparatus comprising:

an image bearing member on which an electrostatic image is to be formed;

a developing device for developing the electrostatic image with a developer;

a developer container detachably mountable to a mounting portion provided in a main assembly of the apparatus, for accommodating a developer;

a first developer accommodating portion for accommodating the developer discharged from said developer container, said first developer accommodating portion being capable of accommodating an amount of the developer, which is larger than a first predetermined amount, wherein the first predetermined amount is larger than a capacity of said developer container;

a discharging device for discharging the developer toward said first developer accommodating portion;

a second developer accommodating portion for accommodating the developer discharged from said first developer accommodating portion, said second developer accommodating portion being capable of accommodating an amount of the developer, which is larger than a second predetermined amount;

a first supplying device for supplying the developer in said first developer accommodating portion toward said second developer accommodating portion;

a second supplying device for supplying the developer in said second developer accommodating portion toward said developing device;

a first detecting device for detecting an amount of the developer in said first developer accommodating portion, wherein said first detecting device is capable of detecting whether or not the amount of the toner in said first developer accommodating portion is equal to or larger than the first predetermined amount;

a second detecting device for detecting an amount of the developer in said second developer accommodating portion; and a controller for controlling, when the developer is accommodated in said developing container, said discharging device such that the amount of the developer in said first developer accommodating portion is not less than the first predetermined amount, in accordance with a detection result of said first detecting device and such that the amount of the developer in said second developer accommodating portion is not less than the second predetermined amount, in accordance with a detection result of said second detecting device, and for permitting, when said developing container is substantially empty, and the amount of the developer in said first developer accommodating portion is less than the first predetermined amount, an image forming operation to continue until the amount of the developer in said second developer accommodating portion becomes less than the second predetermined amount.

2. An apparatus according to claim 1, wherein the second predetermined amount is smaller than the first predetermined amount and smaller than the capacity of said developer container.

3. An apparatus according to claim 1, further comprising:

a third detecting device for detecting a state in which said first developer accommodating portion is capable of accepting an amount of the developer which is not less than the capacity of said developer container; and a display device for displaying that amount of the developer corresponding to an amount corresponding to a plurality of said developer containers can be supplied.

4. An apparatus according to claim 1, wherein the first predetermined amount is the capacity of said developer container multiplied by an integer not less than 2.

5. An apparatus according to claim 1, further comprising:

a third detecting device for detecting that a space larger than the capacity of said developer container exists in said first developer accommodating portion, wherein said controller controls a developer discharging speed of said discharging apparatus so as to be higher than a normal speed, when said third detecting device detects that a space larger than the capacity of said developer container exists in said first developer accommodating portion.

* * * * *